US005367307A

United States Patent [19]

Dupuis et al.

[11] Patent Number: 5,367,307

[45] Date of Patent: Nov. 22, 1994

[54] MICROWAVE PLATE ANTENNA PRINTED ON A SUBSTRATE

[75] Inventors: Philippe Dupuis, Lannion Cedex; Eduardo Motta Cruz, Rennes Cedex; Daniel Jean-Pierre, Rennes, all of France

[73] Assignee: Critt & Universite' de Rennes 1, France

[21] Appl. No.: 762,922

[22] Filed: Sep. 19, 1991

[30] Foreign Application Priority Data

Oct. 3, 1990 [FR] France ..... 90 12273

[51] Int. Cl.[5] ..... H01Q 1/38

[52] U.S. Cl. ..... 343/700 MS; 343/731

[58] Field of Search ..... 343/700 MS, 731; H01Q 21/08, 21/10, 21/12, 1/38, 11/04, 21/06

[56] References Cited

U.S. PATENT DOCUMENTS 3,419,870 12/1968 Wong ..... 343/771
4,398,199 8/1983 Makimoto et al. ..... 343/700 MS
4,899,163 2/1990 Daniel et al. ..... 343/700 MS

*Primary Examiner*—Donald Hajec
*Assistant Examiner*—Steven P. Wigmore
*Attorney, Agent, or Firm*—Laff, Whitesel, Conte & Saret, Ltd.

[57] ABSTRACT

The present invention relates to a micro-wave plate antenna, especially for Doppler radar for example, of the type with a Janus configuration, made up of a plurality of linear sub-networks parallel among themselves, or of a single linear sub-network, each sub-network being made up of a plurality of radiating elements placed on each side of a sub-network feed line, the sub-networks being fed in phase, the length of the sub-network feed line is, between two neighboring elements, a whole multiple of the length of the wave guided over the substratum of the printed circuit on which are printed the radiating elements, and that corresponds to the operational frequency of the antenna. It is such that between two neighboring radiating elements of a same sub-network, the sub-network feed line has at least one bend so that the distance projected on the axis parallel to the transverse direction of the sub-network between two consecutive radiating elements of a same sub-network is inferior to the dimension of these elements in that direction.

21 Claims, 10 Drawing Sheets

MICROWAVE PLATE ANTENNA PRINTED ON A SUBSTRATE

The present invention relates to a mono-beam or to a multi-beam micro-wave plate antenna, especially used as the antenna of a measuring system using the Doppler effect for example, for a speed measuring system.

BACKGROUND

There is known, for example, from the document FR-A-2 622 055, an antenna used in such a system. It has a directional diagram with two main lobes, one of them being asymmetrical from the other relative to a plane that is orthogonal to its main plane. When it is mounted on a vehicle following the Janus configuration, one of the two main lobes is forward slanted and the other one is rearward slanted; the plane of symmetry between these two lobes being orthogonal to the direction of forward motion of the vehicle.

The antenna described in the above document is constituted of a plurality of identical linear sub-networks, that are parallel and symmetrical, the Centers of which are lined up along a line perpendicular to their longitudinal direction, and are fed in phase. Each sub-network is made up of a plurality of radiating elements that radiate from the field in opposition of phase from one element to the next. The step between each element is equal to a wave length guided on the substratum of the circuit on which they are printed and corresponding to the frequency of operation of the antenna.

Advantageously, each radiating element is alternately placed on one side or the other of a secondary feed line fed at the center of symmetry of the sub-networks.

Moreover, each radiating element is made up of a conductor square surface the side of which is approximately equal to the half-length of (the) guided wave. A corner is galvanically connected to the secondary feed line, and the diagonal passing through that point of galvanic contact is perpendicular to the longitudinal direction of the sub-network.

In FIG. 1 there is shown a printed circuit board or plate antenna A that sends two beams F1, F2 through which there passes a plane H located in the axis of the antenna and orthogonal to its surface. These beams are symmetrical relative to a plane E that is orthogonal to plane H and to the surface of antenna A.

An antenna such as just described presents drawbacks. Among the latter, there may be mentioned the fact that it has a radiating power, in plane E, that is relatively high relative to the one sent into plane H. That phenomenon causes difficulties for the treatment of the signal delivered by the antenna, so that, in some cases, errors in measurement may occur.

A second drawback results from its set structure that renders difficult its application to measurement systems with a Janus configuration, that offers special geometrical characteristics. For example, the angle that each lobe forms relative to a perpendicular to the main plane of the antenna, called de-pointing (coil unwinding) angle, is 41.8 degrees and its value can be modified only by changing the material of the substratum, that is to say by modifying its dielectric constant.

SUMMARY OF THE INVENTION

The present invention has as its purpose to remedy these drawbacks, and it proposes an antenna of the above-described type the radiated power of which, in the plane E, is much less than that radiated in the plane H, and the coil unwinding angles of which have values ranging within a wide range of angles.

To that end, a plate antenna according to the present invention is of the above-mentioned type and it is, in addition, characterized in that between two neighboring radiating elements of a same sub-network, the feed line has at least one elbow bend so that the distance projected on an axis parallel to the transverse direction of the sub-network, between two radiating elements of a same sub-network and close to each other, is less than the dimension of the radiating elements in that direction.

Especially, and according to another characteristic of the invention, the radiating elements of a same sub-network are lined up in the longitudinal direction of that sub-network.

By means of that special structure, the gain of the antenna in its E plane is greatly inferior to its gain in its H plane.

According to another characteristic of the invention, the distance between two neighboring radiating elements of a same sub-network is adjusted to determine the angle of inclination of the emitting lobes of the antenna, relative to a perpendicular to its main plane. Of course, the length of the line between two neighboring radiating elements is approximately equal to a multiple of the length of the wave guided over the substratum.

When the distance separating two neighboring radiating elements is decreased, there is increased the value of the coil unwinding angles of the emitting lobes in the H plane. In that direction, there is a limit, because that distance cannot be brought down to zero.

On the other hand, if the distance between neighboring radiating elements is increased, the coil unwinding angles are decreased. Beyond a certain inclination, there is seen the appearance of two secondary lobes with gains of their maximums that are of the same order of magnitude as those of the main lobes.

One of the purposes of the present invention is appreciably to reduce the value of the gains of the maximums of these supplementary lobes.

To that end, each radiating element is constituted by a block that comprises at least two elementary radiating elements that emit in phase relative to each other.

Another purpose of the invention is to bring back the value of the gains of the maximum secondary lobes to that of the main lobes.

To that end, each radiating element is constituted by a block that comprises at least two elementary radiating elements that emit in opposition of phase relative to each other.

Advantageously, the elementary radiating elements of each block are two in number, are aligned along a longitudinal direction of the sub-network, and the distance projected over the longitudinal direction of the sub-network, that separates the two elementary elements of each block, is equal to the distance that separates two blocks of a same sub-network, divided by $2n+1$, n being a positive whole number.

Another purpose of the present invention is to propose a microwave plate antenna, especially for Doppler radar, that has, in the H plane a single lobe slanted over a certain angle relative to a line perpendicular to the main plane of the antenna.

To that end, it has been planned to use sub-networks arranged according to two types of sub-networks, the sub-networks of the first type being made up of elementary radiating elements placed at regular intervals and that radiate in opposition of phase, the sub-networks of the second type being constituted of blocks of elementary radiating elements placed at regular intervals, the elementary radiating elements of each block being placed at regular intervals and radiating fields in opposition of phase, from one element to the next, the distance between two neighboring elementary radiating elements of a same block being equal to the distance between two neighboring blocks of a same sub-network.

BRIEF DESCRIPTION OF DRAWINGS

The above-mentioned characteristics of the invention, as well as others, will appear more clearly upon reading of the following description of an example of execution, that description being given with respect to the attached drawing in which.

Figure 10A:
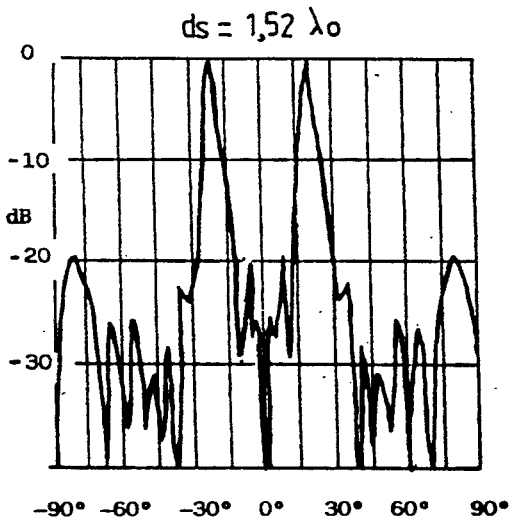
Figure 10B:
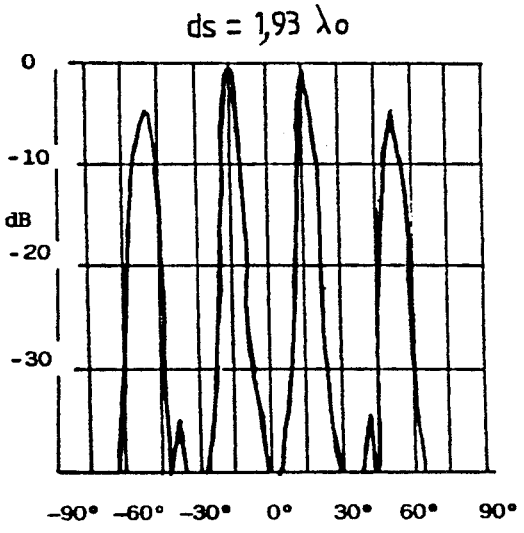

The FIGS. 10*a* and 10*b* represent two directional diagrams by means of which there can be shown the appearance of secondary lobes when the distance between radiating elements becomes greater than a certain value.

Figure 11A:
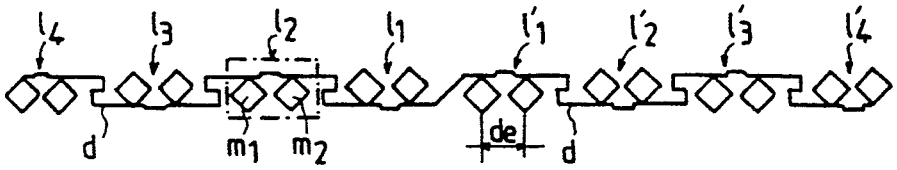
Figure 11B:
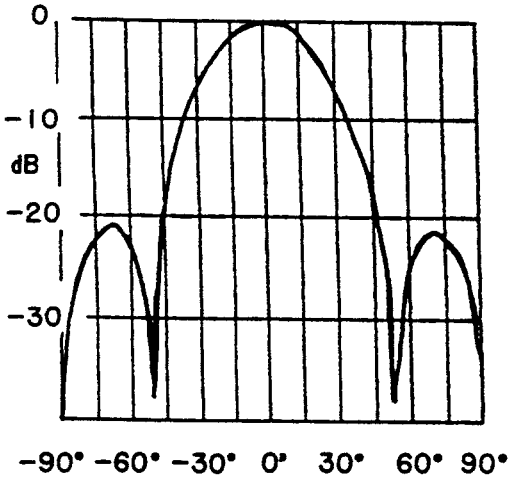
Figure 11C:
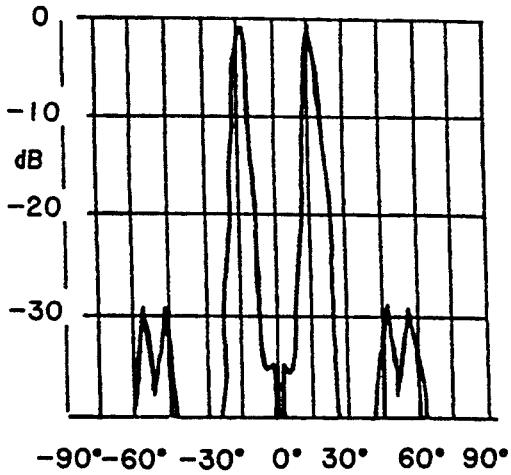

FIGS. 11*a* to 11*c* show a linear network that respectively comprises, as radiating elements, blocks with two elementary radiating elements emitting in phase, a directional diagram obtained in the H plane with a single block, and the directional diagram obtained in the H plane with the linear network in FIG. 11*a*.

Figure 12A:
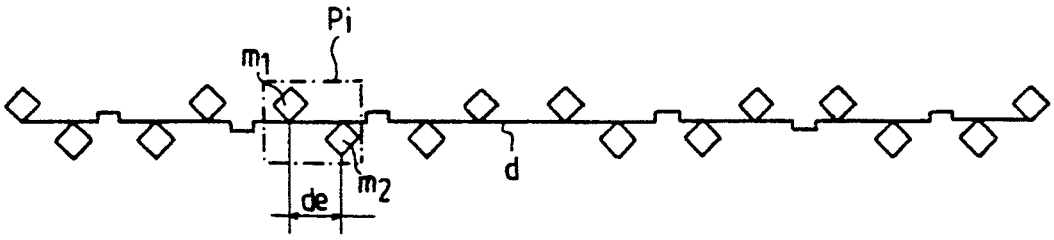
Figure 12B:
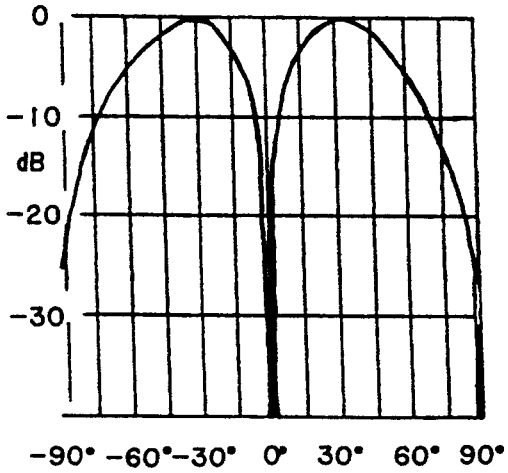
Figure 12C:
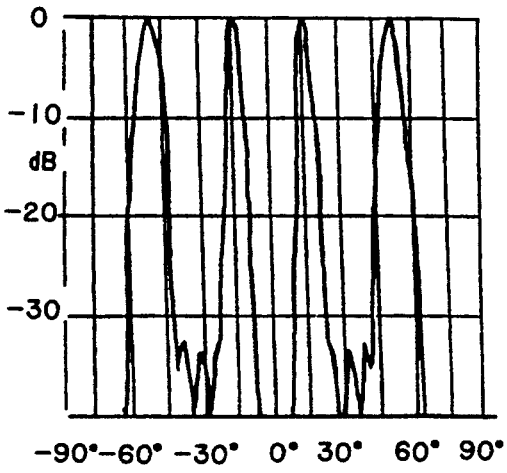

FIGS. 12*a* to 12*c* respectively show a linear network constituted of two elementary radiating blocks that emit in opposition of phase, a directional diagram obtained in the H plane with a single block, and the directional diagram obtained in the H plane with the network in FIG. 12*a*.

Figure 13:
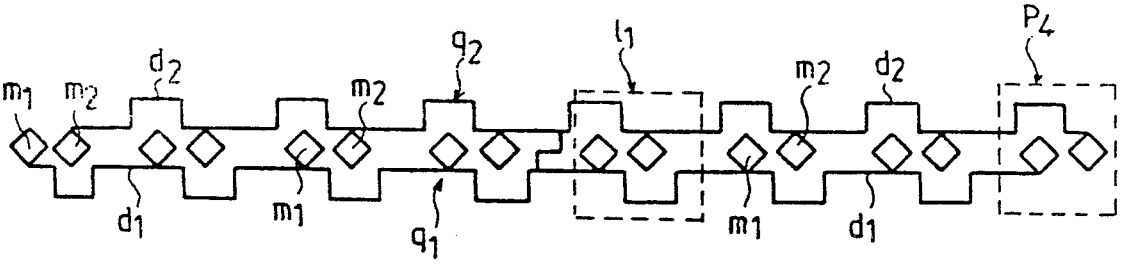

FIG. 13 is a view of an antenna the radiating elements of which are blocks made up of two elementary radiating elements, the elementary elements of each block being fed, respectively, by means of two sub-networks fed at the center by the ends of a line fed at the center.

Figure 14:
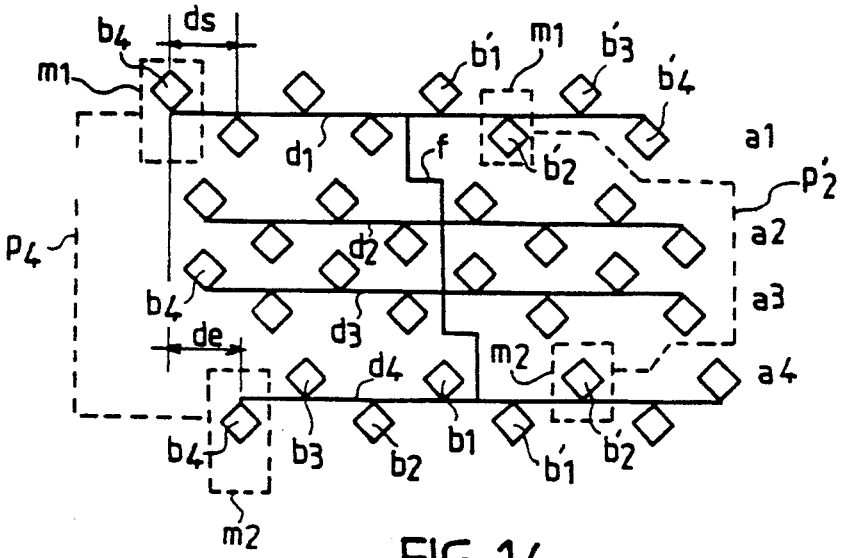

FIG. 14 shows an antenna comprising two networks, one elementary network and a block network.

Figure 15A:
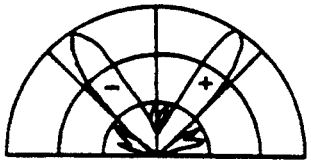
Figure 15B:
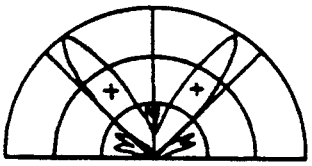
Figure 15C:
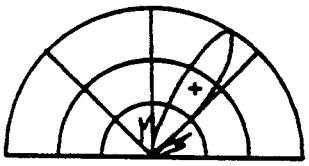
Figure 16:
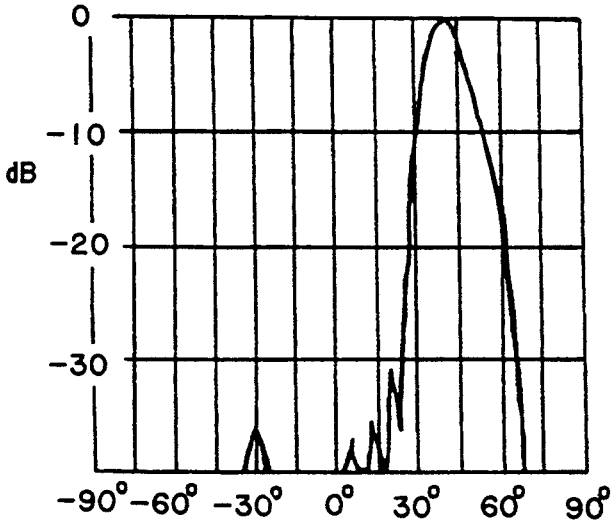

FIGS. 15*a* to 15*c* are curves of the points with constant gain in an H plane perpendicular to the main plane of the antenna, respectively obtained with an antenna such as the one shown in FIG. 14, and FIG. 16 is a directional diagram obtained with an antenna such as that shown in FIG. 14.

DETAILED DESCRIPTION

Figure 1:
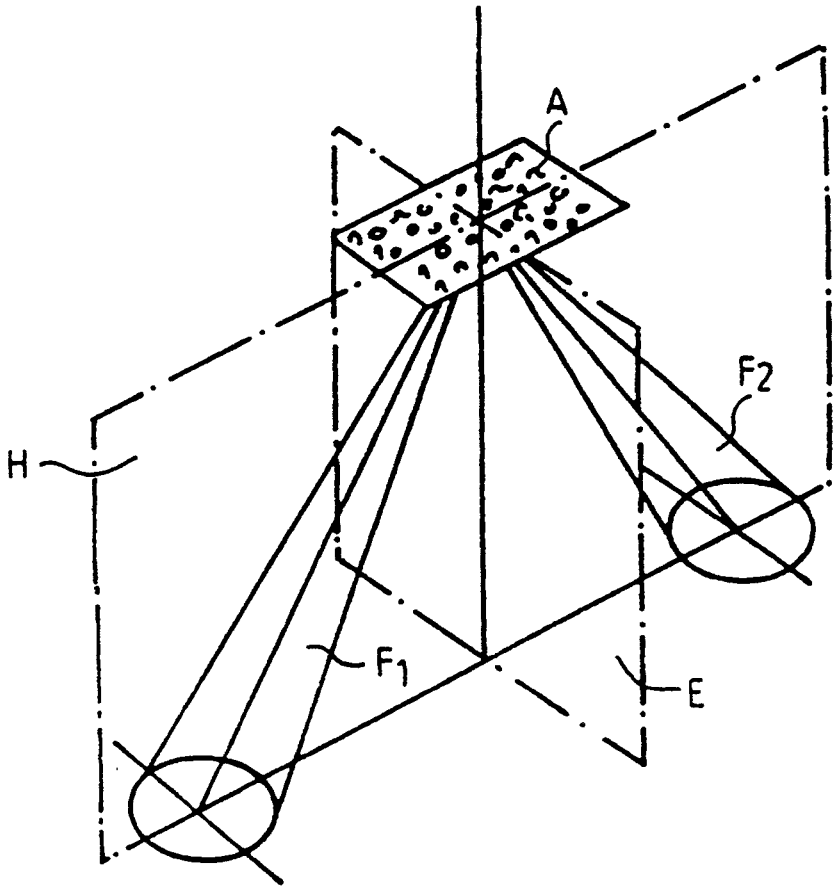
FIG. 1 PRIOR ART
FIG. 1 is a perspective view of an antenna.
Figure 2A:
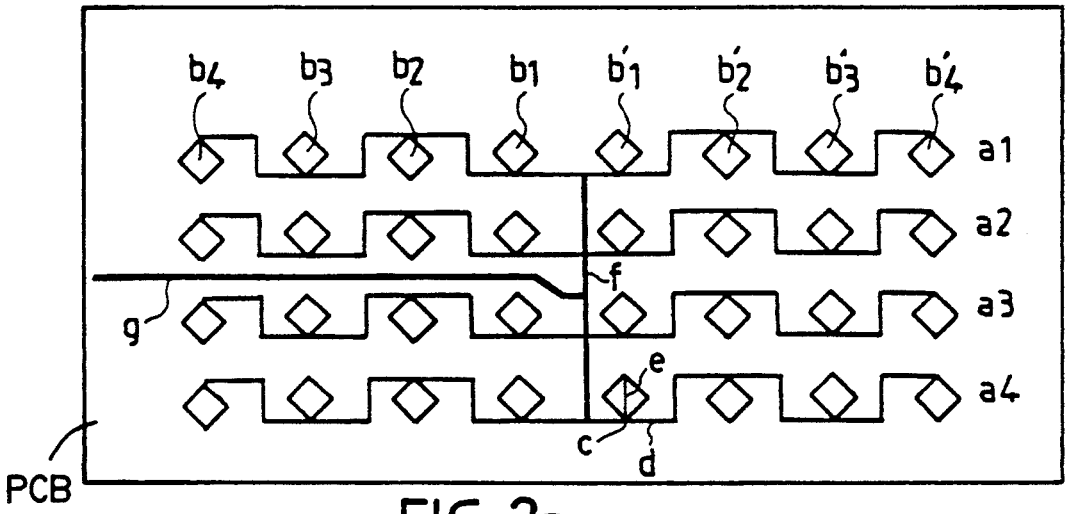
FIGS. 2*a* to 2*c* show antenna examples in which the networks are made up of several sub-networks, differently fed from one antenna to the other.
Figure 2B:
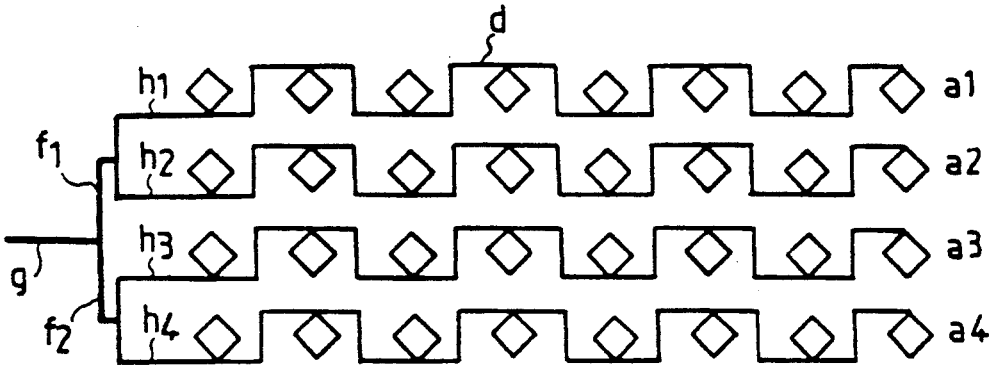
Figure 2C:
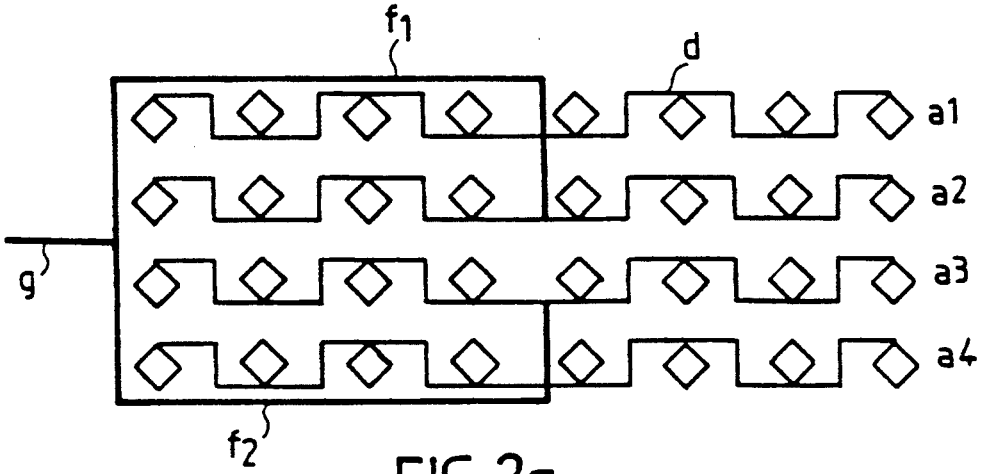

The antennas shown in FIGS. 2*a* to 2*c* are all constituted by a network of four rows a1, a2, a3, and a4 of radiating elements b1, b2, b3 and b4, b1′, b2′, etc., that are identical and parallel and are printed on a printed circuit board PCB. Each of the other antennas shown in the drawings also has a printed circuit board, which is omitted for clarity. Row aj constitutes a linear sub-network of radiating elements bi.

Figure 4:
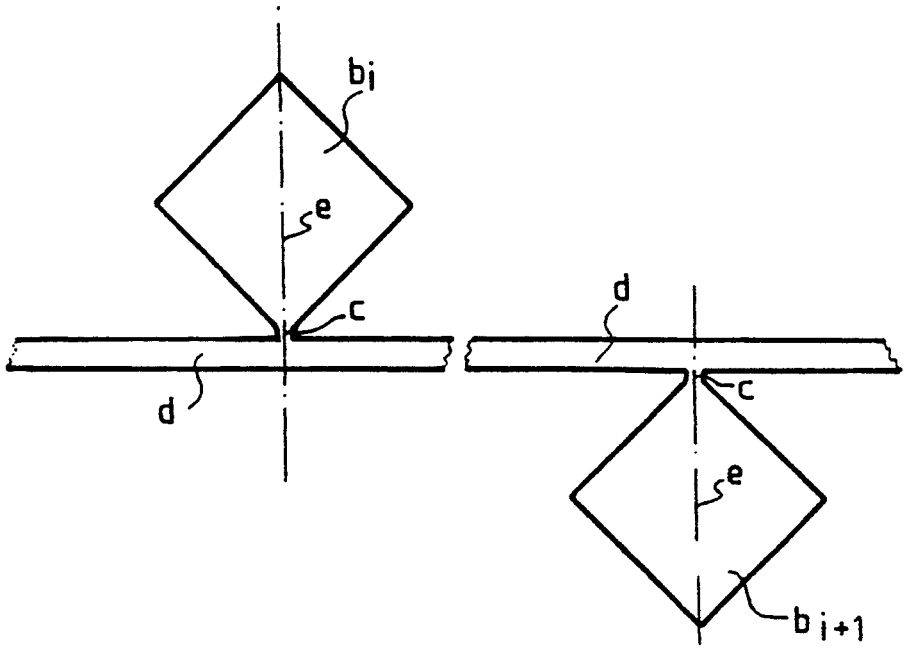
FIG. 4 is an enlarged view of two radiating elements galvanically connected to a feed line.

The antennas according to the present invention comprise a plurality of radiating elements bi (FIGS. 2*a* and 2*c*) that are, each one of them, constituted (FIG. 4) by a square conducting surface a corner c of which is galvanically connected to a sub-network feed line d, the diagonal e passing by the galvanic contact point c being perpendicular to line d at point c. The side of the square has a dimension approximately equal to one-half length of the wave guided on the printed circuit or substratum of the antenna at the operating frequency of the latter. That particular form of radiating element, even though it presents certain advantages, especially the fact that it can be perfectly modelled, is not at all mandatory for the good operation of the described antennas.

In the antennas according to the invention, two neighboring radiating elements bi and bi+1 generally emit in opposition of phase. Being fed in phase by the feed line d, these two elements are on one side and the other of the line d that feeds them.

In FIG. 2*a* there is shown a configuration, hereafter called star-shaped, in which each sub-network aj is formed of two half sub-network, symmetrical to each other relative to its center. The sub-networks a1, a2, a3 and a4 are connected to a common line f perpendicular to the longitudinal direction of the sub-networks at a feed point located on line d in a manner such that elements b1 and b1′ that frame the center of symmetry of the sub-network will radiate in opposition of phase. These elements b1 and b1′ being on a same side of line d, the feed point is shifted relative to the center of symmetry of the sub-network, by one-half the length of the guided wave λg on the substratum where there are printed the radiating elements bi, and at the frequency of operation of the antenna. At the center of line f, there is connected the feed line g of the antenna.

The antenna in FIG. 2*b* shows a configuration hereafter called arborescent, in which the ends of the sub-networks a1, a2, a3, and a4 respectively are connected to lines h1, h2, h3, and h4. The lines h1 and h3 respectively present two points common with lines h2 and h4. These common points respectively are connected to two lines f1 and f2 that also have a common point connected to the feed line g of the antenna.

The antenna in FIG. 2*c* shows a mixed configuration. The sub-networks a1 and a2 are connected together in a star-shaped configuration. Likewise, the sub-networks a3 and a4 are connected together in a star-shaped configuration. The two couples thus formed are respectively connected to two lines f1 and f2 that have a common point connected to the feed line g of the antenna.

From these three basic configurations, it is relatively easy for the technician to imagine other configurations that may comprise, for example, a larger number of sub-networks aj, arranged in parallel or not, in twos, or in threes or more, in arborescent or in mixed configurations.

These configurations have approximately equivalent radiation characteristics. There must be mentioned the fact that, in a network that combines several sub-networks, the sub-networks aj must be fed in phase in order for each sub-network to be able to add its effects to those of the other sub-networks. To that end, there are adjusted among themselves the lengths of the sections of line f. Quarter-wave transformers may be included in these line sections to weight the sub-networks in amplitude relative to one another.

Figure 3:
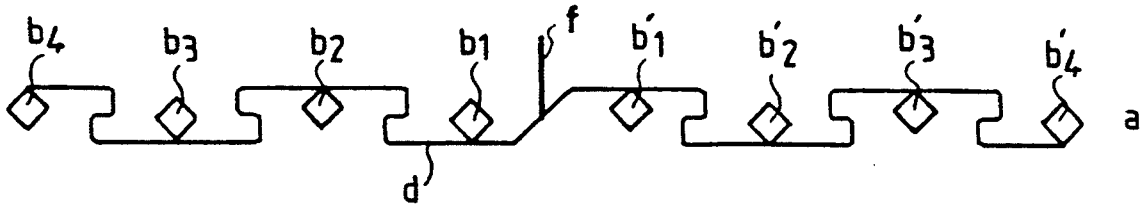
FIG. 3 is a view of an antenna constituted of a single linear sub-network.

There is also shown (FIG. 3) an antenna constituted by a network comprising a single linear sub-network a, symmetrical relative to its center and fed at its center by a line f. It will be noted that, in that case, the elements b1 and b1' framing the center of symmetry of the sub-network are located on each side of the feed line d of the sub-network. Let us note that this sub-network could also be fed by one of its ends.

There will now be described special sub-networks that constitute the object of the present invention. They may be arranged as a network according to the configurations shown in FIGS. 2*a* to 2*c* and 3.

Figure 5A:
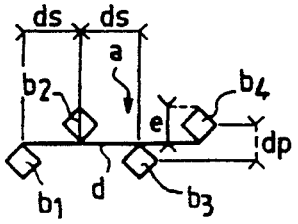
FIGS. 5*a* to 5*c* show antenna sub-networks according to the invention, these sub-networks having different structures.
Figure 5B:
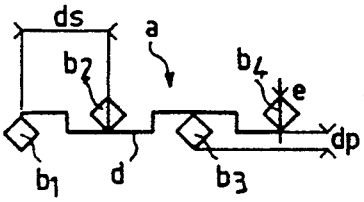
Figure 5C:
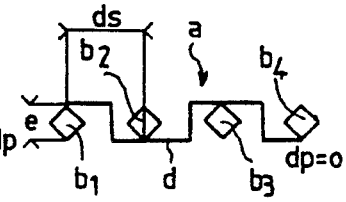

The FIGS. 5*a* to 5*c* show sub-networks a with four elements b1, b2, b3 and b4. In FIG. 5*a*, the feed line of sub-network is rectilinear, and the distance ds that separates two neighboring radiating elements bi and bi+1 is a whole multiple (in this case the unit) of the length of the wave guided by the feed line on the substratum of the circuit on which they are printed. That wave length will be noted hereafter as λg. The distance dp projected on an axis transverse to the sub-network, that separates two neighboring elements bi and bi+1 is equal to the dimension e of the radiating elements in that transverse direction, that is to say, in this case, the length of a diagonal e of the square forming the elements. That sub-network is the one described in document Fr-A-2 622 055.

Figure 6A:
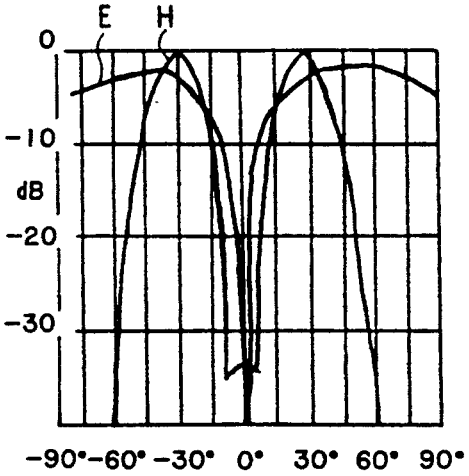
FIGS. 6*a* to 6*c* show directional diagrams in the E and H planes, respectively obtained with antennas comprising the sub-networks of FIGS. 5.

In order to characterize the directivity of an antenna, there is traced a diagram of the gain as a function of the angle formed by the direction of measurement with a perpendicular to the main plane of the antenna, a diagram that hereafter will be called directional diagram. FIG. 6*a* shows such a diagram in the E plane and in the H plane of emission of an antenna executed from the sub-network in FIG. 5. There is seen, in the H plane, the presence of two maximums in directions that form, with a perpendicular of the antenna plane, angles of approximately +30 and −30 degrees and, in E plane, the presence of two maximums in directions of approximately +40 and −40 degrees. The maximum power sent into the E plane is inferior by approximately −3 dB to the maximum power sent into the H plane.

The presence of the two maximums in the E plane causes difficulties in the treatment of the signal received from the antenna, when the latter is used in a system of speed measurement in the H plane, said system being of the Janus configuration type.

It has therefore been thought to remedy this problem and, to that end, it has been thought of reducing (FIG. 5*b*), even to annul the transverse distance between two neighboring elements bi and bi+1. In FIG. 5*b*, the transverse distance dp is equal to the half-length of a diagonal e of a square forming an element bi and, in FIG. 5*c*, that distance dp is zero. In this latter case, the bi elements are lined up in the longitudinal direction of the sub-network.

It will be noted that the feed lines d of the sub-networks in FIGS. 5*b* and 5*c* are not rectilinear, but present two bends.

Figure 6B:
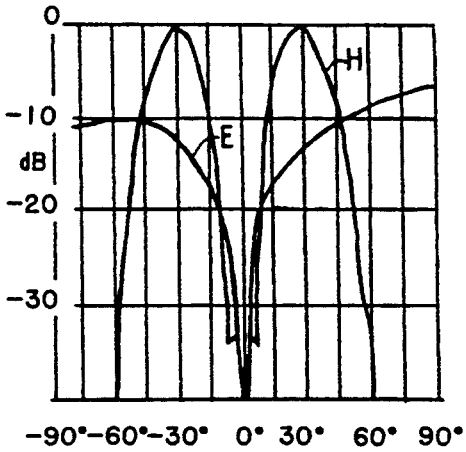
Figure 6C:
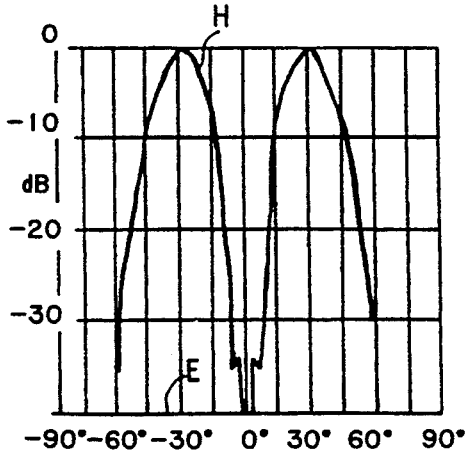

There are shown, in FIGS. 6*b* and 5*c*, the directional diagrams of two antennas that respectively use the two sub-networks in FIGS. 5*b* and 5*c*. It may be seen that, although the amplitudes of the maximums in the H plane are approximately the same as those of the same maximums of the sub-network in FIG. 5*a*, the amplitudes of the maximums in the E plane are weakened (−10 dB, FIG. 6*b*), even annulled (FIG. 6*c*).

In a linear network of radiating elements equidistant by ds and fed so that two consecutive elements emit waves in opposition of phase, the directional diagram in plane H shows two main lobes that are slanted relative to the perpendicular of the main plane of the antenna, by 30 degrees and −30 degrees, the values of those two angles being given by the relation $$\theta = \arcsin\left(\frac{\lambda O}{2ds}\right)$$

in which λO is the length of a wave in vacuum at the operating frequency of the antenna.

Thus, by varying the distance ds between the radiating elements bi, it is possible to cause variations in the angles of inclination of the main lobes.

In the antennas according to the present invention, the radiating elements bi are fed in points alternately located on one side and on the other of the feed line d of the sub-network, so that, in order for two consecutive elements bi and bi+1 to emit in opposition of phase, they must be fed in phase. Between two neighboring elements bi and bi+1, line d consequently must have a length L equal to a whole multiple of the length of the wave guided in the substratum, at the operating frequency of the antenna.

Figure 7A:
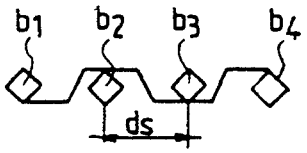
FIGS. 7*a* to 7*c* show sub-network structures that can equip an antenna according to the invention, the distances between neighboring radiating elements being different from one structure to another.
Figure 7B:
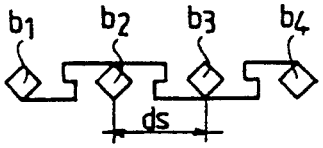
Figure 7C:
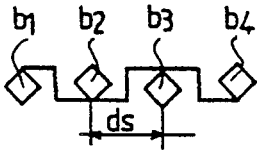
Figure 8A:
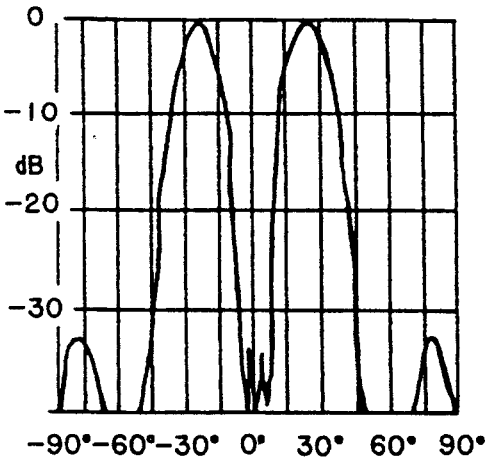
FIGS. 8*a* to 8*c* show the directional diagrams respectively obtained in the H plane, with antennas containing the sub-networks of the FIGS. 7*a* to 7*c*.
Figure 8B:
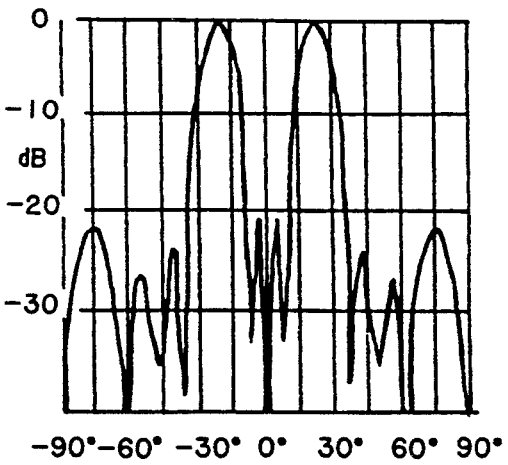
Figure 8C:
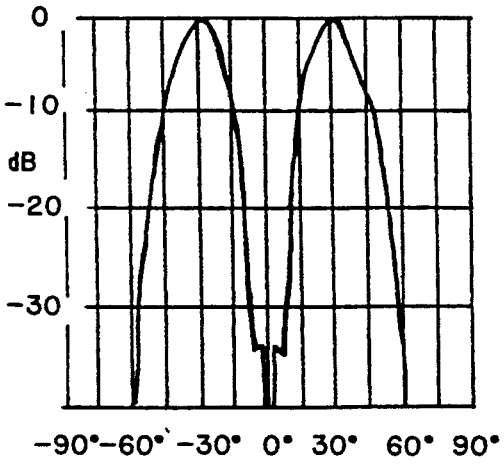

There have been executed antennas in which the sub-networks shown in FIGS. 7*a* to 7*c* have different distances ds between neighboring radiating elements bi and bi+1. In FIG. 7*a*, the distance ds is 1.22 λO and the length L of the feed line d, between two consecutive radiating elements bi and bi+1 is 2 λg. The directional diagram obtained with an antenna network using this sub-network shows (FIG. 8*a*), in the H plane, two lobes respectively slanted by +25 and −25 degrees.

In FIG. 7*b*, the distance ds is 1.33 λO and the length L of the line is 3 λg. The corresponding directional diagram shows, in the H plane, two lobes respectively slanted by +22 and −22 degrees.

Finally, in FIG. 7*c*, the distance ds is λO and the length L is 2 λg. The corresponding directional diagram shows, in the H plane, two lobes respectively slanted by +30 and −30 degrees.

Figure 9:
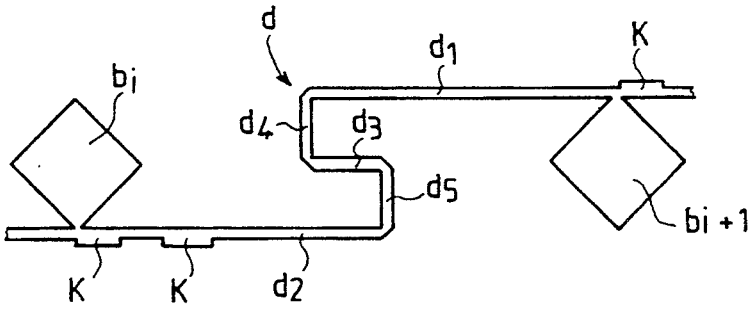
FIG. 9 shows the geometry of the part of a network feed line that connects two radiating elements.

In order to have a general design of line s that can fit different distances ds between neighboring radiating elements bi and bi+1, it has been provided to bend line d between these two elements (FIG. 9) so that it will have the shape of an "S", The upper line section d1 and the lower line section d2 respectively have lengths L1 and L2, the central line section d3 has the length L3 and the two vertical line sections d4 and d5 respectively have the lengths L4 and L5. In FIG. 9, L1=L2, and L4=L5. Besides, if L designates the length of line d between two elements bi and bi+1, we have:

$$L = L1 + L2 + L3 + L4 + L5$$

and we must have $L=n\lambda g$

Advantageously, the feed line d does not present any change in direction close to the radiating elements bi. The "S" shape is approximately equal to the distance between the two elements bi and bi+1. If these change were very close to the radiating elements bi, there might result from this, couplings between line d and the radiating elements bi, and this would produce disturbances in the characteristics of the antenna.

There will be noted, in FIG. 9, the presence, on line d, of elements k obtained by increasing the width of the feed line d. These elements are weighting elements that weight the gains of the radiating elements placed downstream on line d. They are well known by the technician and are, for example, described in the document Fr-A-2 622 055.

By causing distance ds to vary between elements bi, it is possible to cause variations in the coil unwinding angle of the antenna over a rather important range of angles. One is nevertheless limited, with respect to the upper value, by the distance ds that cannot be less on a certain value since two consecutive elements bi and bi+1 cannot be in contact with each other but on the contrary must leave a space for the feed line d (and possibly for its bends). In practice, the upper value is approximately 55 degrees.

For distances between bi elements greater than 1.5 λO and that give unwinding angles inferior to 19.5 degrees, there is noted the appearance, in the directional diagram obtained in the H plane, of two secondary lobes in which the gains of the maximums are of the same order of magnitude as those of the main lobes. There are shown, to illustrate that effect, directional diagrams in the H plane (FIGS. 10*a* and 10*b*) respectively obtained with linear networks of eight elements bi spaced by ds=1.52 λ0 and ds=1.93 λ0. In the first case, the secondary lobes appear for angles of approximately +80 and −80 degrees, with an attenuation, relative to the maximums of the main lobes, of −19 dB. In the second case, the secondary lobes appear for angles of approximately +51 and −51 degrees with an attenuation of only −4 dB.

It could be shown that the secondary lobes appear in the H phase at inclinations the angle values of which, relative to a perpendicular to the antenna, are given by the relation:

$$\theta n = \arcsin\left(\frac{(2n+1)\lambda 0}{2ds}\right)$$

in which n is the order of appearance of the secondary lobes. In FIGS. 10*a* and 10*b*, n=1 and $$\theta n - \arcsin\left(\frac{3\lambda 0}{2ds}\right)$$

The relatively important attenuation (−19 dB) observed for ds=1.52 λ0 is due to a secondary effect ascribed to the special geometric shape of the radiating elements bi, a square the side of which approximately equals the half-length of the guided wave λg.

For relatively important ds distances, that effect not longer operates, and the gains of the maximums of the secondary lobes are only slightly lower than the gains of the main lobes.

It has been thought of using, as radiating element bi, a block li made up of two radiating elements m1 and m2 separated by a distance equal to de and located on a same side of the feed line d of the sub-network (FIG. 11*a*). The length of the line section d that separates the two elements m1 and m2 of a same block li is a whole multiple of the length λg of the wave guided on the substratum (here it is equal to λg). The elements m1 and m2 thus emit waves in phase. There is shown in FIG. 11*b* the directional diagram in the H plane of such a block. It can be seen that it comprises a relatively large lobe centered around 0 degree and two secondary lobes that form, with the main lobe, two maximums the inclination angle values of which are given by the relation:

$$\theta e = \arcsin\left(\frac{\lambda O}{2de}\right)$$

In FIG. 11*b*, the distance de is equal to 0.51 λO and θe is equal to 55 degrees.

In order to annul the gain of the secondary lobes, distance de is chosen such that the value d(?) of the inclination angles of the minimums of the blocks will correspond to the values of the angles of the maximums of the secondary lobes. There is then obtained θe=θ1, that is:

$$\theta 1 = \arcsin\left(\frac{3\lambda O}{2ds}\right) = \theta e = \arcsin\left(\frac{\lambda O}{2ds}\right)$$

$$\text{or also } de = \left(\frac{ds}{3}\right)$$

There was executed a linear network of eight blocks li. The distance ds between the blocks li is 1.93 λO and, in each block the two elements m1 and m2 are distance by 0.64 λO. There is shown in FIG. 11*c*, the directional diagram obtained in the H plane with such a network. The two main lobes are slanted at approximately +15 and −15 degrees and the supplementary lobes at approximately +55 and −55 degrees, The latter show an attenuation of −28 dB relative to the maximums of the main lobes.

Instead of weakening the secondary lobes, it has been attempted, on the contrary, to make their gain approximately equal to that of the main lobes. The objective pursued is to supply a four-beam antenna that can be used in speed measurement systems by the Doppler effect. It makes it possible to offer a redundance of lobes that may prove useful, for example when the system analyses a surface with a low retrodiffusion coefficient (puddle of water, of oil, sheet of snow or of ice, etc.).

To bring the values of the gains of the maximums of the secondary lobes up to the values of the gain of the main lobes, there have been used blocks Pi made up of two radiating elements m1 and m2 in opposition of phase (FIG. 12*a*). To that end, the section of line d that separates them is a whole multiple of the length λg of the guided wave and they are located on each side of line d. They are separated by a distance equal to de. The radiation diagram in the H plane of a block Pi alone (FIG. 12*b*) shows two maximums located on each side of the perpendicular to the block.

There was executed a linear network of eight blocks Pi, distant by ds=1.93 λO and the elements m1 and m2 of which are distant by de=0.75 λO. FIG. 12*c* shows the directional diagram obtained in the H plane by such a network. There is observed the evenness of the gains of the maximums of the four lobes respectively slanted by −55, −15, +15, +55 degrees.

It may be necessary, in some cases and in order to obtain a low level from the other secondary lobes, to provide, between the consecutive blocks Pi, quarter wave transformers.

By decreasing the distance de between the elements mi of each block Pi, the radiation diagram of each block Pi is displaced toward angles of higher value, this bringing about a reduction of the gains of the maximums of the main lobes, relative to those of the secondary lobes. By increasing distance de, the opposite effect is obtained.

The two elements m1 and m2 of the blocks li (FIG. 11*a*) or of the blocks Pi (FIG. 12*a*) are connected to a same feed line d. In fact, as shown in FIG. 13, they may be fed by two distinct lines d1 and d2, each line dj with the elements mi connected to it forming a sub-network qj. In order for an element mi to be either in phase or in opposition of phase with one of its neighbors, depending on the effect sought, it is necessary to adjust the length of the line sections di between elements mi, and to provide for a correct feed of each sub-network qj. In FIG. 13, there is shown a linear network made up of two sub-networks q1 and q2 fed in phase, the whole presenting eight blocks li distant by ds=1.93 λO, and the elements m1 and m2 of which are respectively fed by their opposite corner thus emitting in opposition of phase. The distance between mi elements is 0.75 λO. The directional diagrams obtained in the H plane for the source and for the network are equivalent to those respectively shown in FIGS. 11*b* and 11*c*.

The antennas described up to this point have two or four lobes and therefore they can be used in a system of speed measurement that shows a configuration of the Janus type. Even though these systems make it possible to perform a measurement that is independent of the inclination of the vehicle, relative to the ground, they do not make possible the detection of the direction of displacement of the vehicle. It may prove useful, in certain applications, to determine the speed and the direction of displacement of the vehicle, the orientation of same relative to the ground remaining approximately constant in these applications.

To that end, there is used an antenna the single emitting/receiving lobe of which, in the H plane, is slanted relative to the ground and, therefore to its main plane. Such an antenna has been executed (FIG. 14). It is made up of four sub-networks a1, a2, a3, and a4 parallel among themselves and fed at their center by a line f. Each sub-network aj is symmetrical relative to its center and has, on each side of the latter, four radiating elements bi spaced by a same distance equal to ds and located on each side of the feed line dj of the sub-network aj. The feed line shows two bends so that the first sub-network a1 is longitudinally shifted by ds/2 relative to two central sub-networks a2 and a3, and the last sub-network a4 also is longitudinally shifted, by ds/2, in the direction opposite that of the first network a1. The radiating elements bi advantageously are square surfaces such as those already described.

This special antenna operates as follows. The two central sub-networks a2 and a3 form a network such as the one already described in document FR-A-2 622 055. It could be executed with a structure similar to one of those shown in FIGS. 2, 3, 4, and 7. In the H plane, that network has a directional diagram comprising two lobes slanted relative to the perpendicular to the plane of the antenna, inside which the waves sent are in opposition of phase (FIG. 15*a*). The inclination of the lobes is a function of the distance ds between elements bi.

The two external sub-networks a1 and a4 form a second network in which the elements bi corresponding to each other in a sub-network a1 and in the other sub-network a4 form a block of elements m1 and m2 in opposition of phase, such as those described with respect to FIGS. 11 and 13*a*. These element m1 and m2 are fed in phase by line dj of sub-network aj, and they are respectively directed in one direction and in the other. Therefore they are emitting in phase.

It will be noted that the feed line sections of sub-networks a1 and a4, that is to say those that respectively connect the sub-networks a1 and a2, and the sub-networks a3 and a4, are longer than a whole multiple of the length λg of a guided wave. They have, in fact, a length of $\lambda g+\frac{1}{4}\lambda g$. Indeed, in order for the sub-networks a1 and a4 to be able to act as a sub-network of blocks with two radiating elements, it is necessary that, on one part, they be fed in phase relative to each other and that, for the other part, they be fed dephased by more or less 90 degrees relative to the sub-networks a2 and a3.

The distance between two blocks pj and pj+1 is equal to ds. In order for the sub-networks a1 and a4 to send a power approximately equal to the power sent by the sub-networks a2 and a3, ds and de are chosen, for the sub-networks a1 and a3, such that the inclination of the lobes created by each block Pi will be equal to the inclination of the lobes created by the sub-network, that is to say ds=de. There can be understood the need of two distinct sub-networks to feed each element m1 and m2 of a block pi.

Now, one network of blocks pi constituted of two elements m1 and m2 emitting in opposition of phase has a directional diagram that has, in the H plane, two lobes symmetrical relative to the perpendicular to its main plane, one lobe being in phase relative to the other (FIG. 15*b*).

The network constituted of four sub-networks a1, a2, a3 and a4 has a directional diagram that is constituted, in the H plane, by the vectorial sum of the waves sent by each sub-network. Because the distances between radiating elements bi are the same in each sub-network, and because, consequently, the inclinations of their main lobes are equal, on one side the waves in opposition of phase sent by each one of the sub-networks a1 and a4, and a2 and a3, are mutually cancelled while on the other side, they are added to each other. The result (FIG. 15*c*) is an antenna of which the directional diagram in the H plane shows a single lobe slanted relative to the perpendicular to the antenna (FIG. 16). That inclination is a function of the distance ds between radiation elements.

One of the aspects of the invention relates to the structure of the blocks used as radiating elements. There have been described blocks with two elements oriented in the longitudinal direction of the sub-network to which they belong. The invention is not limited to such blocks. Indeed, blocks of three or four (or more) elements may be considered. With such blocks, as before, the gain characteristics of each block combine with the gain characteristics of an antenna of the same structure but that would be equipped with elementary radiating elements, this making it possible to obtain new gain characteristics.

There have been described structures that amplify or that annul the secondary lobes of the first order. It would be possible to think of antennas comprising one or several sub-networks in which the blocks have different distances de between the radiating elements so as to be able to cancel or to amplify the first secondary lobes of the first order, the second lobes of the second order, etc. It is then possible to execute six- or eight-beam antennas and/or antennas the main beams of which have a low inclination, lower than 12 degrees for example, and even 9 degrees.

Let us note that the feed lines of the radiating element may comprise quarter wave transformers in order to weight the feed of each individual element.

We claim:

1. A microwave antenna comprising a printed circuit on a printed circuit board, a central feed line on said printed circuit board for connection to an antenna lead of a microwave system, a plurality of printed sub-network feed lines connected perpendicularly to opposite sides of said central feed line, each of said sub-network feed lines having a plurality of elementary radiating elements connected thereto with adjacent radiating elements projecting in opposite directions away from said sub-network feed lines, each of said radiating elements having an opposite end remote from said connection between said radiating elements and said sub-network feed line, and bends formed in said sub-network feed line between adjacent radiating elements, said bends causing said opposite ends of adjacent radiating elements to be separated by a distance perpendicular to said sub-network feed line which is no more than a distance between the sub-network feed line and said opposite end of a radiating element.

2. An antenna according to claim 1, wherein said radiating elements of each sub-network are aligned in a direction perpendicular to the sub-network feed line.

3. An antenna according to claim 2, wherein between each two neighboring radiating elements of a same sub-network, the sub-network feed line has two line sections parallel to a longitudinal direction of the sub-network and respectively connected to said radiating elements, a third line section that forms a certain angle with respect to the first two line sections, said third line section connecting ends of said two line sections.

4. An antenna according to claim 1 or 2, wherein between two neighboring radiating elements belonging to a same sub-network, the feed line of the sub-network has an "S" shape with two end line sections respectively connected to said radiating elements, and a central line section comprising two sections perpendicular to the sub-network feed line, and a line section approximately perpendicular to the two perpendicular central line sections and parallel to the two end line sections and that interconnect in order to form said "S" shape.

5. An antenna according to claim 1 or 2, wherein at least an elbow is formed in the sub-network feed line between two neighboring radiating elements of a same sub-network, and is approximately equal to the distance between the radiating elements.

6. An antenna of claim 1, wherein said the plurality of sub-networks are divided into groups of sub-networks, said plurality of sub-networks being fed by a star-shaped configuration and the groups of said sub-networks being fed according to an arborescent configuration.

7. An antenna according to claims 6 or 2, characterized in that each radiating element is a conducting square surface having a side which is approximately equal to one half the length of the guided wave, one corner of each conducting square being galvanically connected to the feed line of the sub-network and a diagonal of each conducting square that passes by said corner of galvanic contact is perpendicular to the longitudinal direction of the sub-network.

8. An antenna according to claim 2, characterized in that each radiating element is constituted by a block that comprises at least two elementary radiating elements that emit in phase relative to one another.

9. An antenna according to one of claims 6 or 2, characterized in that each radiating element is constituted by a block that comprises at least two elementary radiating elements, some of the elementary radiating elements emitting in phase opposition relative to the other elementary radiating elements of the same block.

10. An antenna according to claim 8, characterized in that the elementary radiating elements of each block are two in number.

11. An antenna according to claim 8, characterized in that a distance projected on the longitudinal direction of the sub-network that separates the two elementary elements of each block, is equal to a distance that separates two blocks of a same sub-network divided by $2n+1$, n being a whole positive number.

12. An antenna according to claim 8, wherein said antenna comprises, as radiating elements in each sub-network, blocks with at least two elementary radiating elements of a first type of block being separated by a first distance equal to the distance that separates two consecutive blocks of said first type divided by $2n+1$, with $n=1$ for at least one first type sub-network of said antenna, with $n=2$ for at least one second type sub-network of said antenna, and with $n=k$ for at least one kth type sub-network.

13. An antenna according to claim 8, characterized in that the elementary radiating elements of the blocks are respectively fed by two linear sub-networks parallel between them and are themselves fed in phase.

14. An antenna according to claim 8, characterized in that each elementary radiating element is a square conducting surface having a side which is approximately equal to one half the length of the guided wave, one corner of each elementary radiating element being galvanically connected to the feed line of the sub-network and the diagonal of the elementary radiating element that passes by said galvanic connecting corner being perpendicular to the longitudinal direction of the sub-network.

15. An antenna according to one of claims 6 or 2, characterized in that the sub-networks are arranged according to two types of sub-networks, the sub-networks of the first type being made up of radiating elements that radiate in opposition phase, the sub-networks of the second type being made up of blocks comprising at least two elementary radiating elements that radiate fields in opposition of phase from one element to a next, a distance between two neighboring elementary radiating elements of a same block being approximately equal to the distance between two neighboring blocks of a same sub-network, the sub-network of the second type being fed with a dephasing of more or less 90 degrees relative to the sub-networks of the first type.

16. An antenna according to claim 15, characterized in that each sub-network of the second type is made up of two linear sub-networks which are symmetrical relative to each other and longitudinally shifted relative to the other, said sub-networks being separated by a distances equal to a distance that separates two elementary radiating elements of each one of these sub-networks.

17. An antenna according to claim 15, characterized in that each radiating element of the sub-networks of the first type and each elementary radiating element of the sub-networks of the second type are constituted by a conducting square surface having a side which is approximately equal to one half the length of a guided wave, the corner of said square being galvanically connected to the feed line of the sub-network and the diagonal of said square passing said corner galvanic contact and being perpendicular to the longitudinal direction of the sub-network.

18. An antenna of claim 6, characterized in that the feed of the groups of said sub-networks is arranged in a star-shaped configuration.

19. An antenna of claim 6, characterized in that the feed of the plurality of sub-networks is being arranged in an arborescent configuration.

20. The antenna of claim 1 wherein there are a plurality of said sub-networks which are parallel among themselves, the sub-networks being fed in phase.

21. An antenna according to claim 6, wherein between each two neighboring radiating elements of a same sub-network, the sub-network feed line has two line sections parallel to a longitudinal direction of the sub-network and respectively connected to said radiating elements, a third line section that forms a certain angle with respect to the first two line sections, said third line sections connecting ends of said two line sections.

* * * * *